United States Patent [19]

Gasparaitis et al.

[11] 4,205,319

[45] May 27, 1980

[54] FLEXIBLE DIPOLE ANTENNA FOR HAND-HELD TWO-WAY RADIO

[75] Inventors: Bernard Gasparaitis, Ft. Lauderdale; Charles D. Albright, Lantana, both of Fla.

[73] Assignee: Motorola, Inc., Schaumburg, Ill.

[21] Appl. No.: 903,318

[22] Filed: May 5, 1978

[51] Int. Cl.[2] ..... H01Q 9/16

[52] U.S. Cl. ..... 343/792; 343/702

[58] Field of Search ..... 343/702, 828–830, 343/790–792, 793, 752, 802

[56] References Cited

U.S. PATENT DOCUMENTS

| | | | |
|---|---|---|---|
| 2,492,404 | 12/1949 | Streib et al. | 343/791 |
| 3,932,873 | 1/1976 | Garcia | 343/792 |

*Primary Examiner*—David K. Moore

*Attorney, Agent, or Firm*—Margaret Marsh Parker; James W. Gillman

[57] ABSTRACT

A completely flexible dipole antenna is formed from coaxial cable having a braided wire core with skirt also formed of shielding over a flexible sleeve. A coil spring which is not electrically active supports the antenna above the connector. A non-wearing female connector utilizes a flexible conductive elastomer contact contained within an insulating body.

4 Claims, 4 Drawing Figures

FLEXIBLE DIPOLE ANTENNA FOR HAND-HELD TWO-WAY RADIO

BACKGROUND OF THE INVENTION

This invention relates to the field of antennas and particularly to flexible, rugged, gain antennas for use on hand-held portable radios.

Several types of antennas are presently used on hand-held radios, the most common being quarter wave whips and physically shorter quarter wave helical antennas. Quarter wave antennas tend to have ground firing lobes with nulls just above the horizon. There is also a strong tendency to have a deep null behind the head of the person holding the radio. Both characteristics are undesirable in hand-held radios as for public safety work. The second major consideration in such design is ruggedness, since portable radios in public safety work are exposed to extremely rough handling, including being dropped on the antenna or being held and swung about by the antenna. Thus, such antennas must be capable of withstanding repeated flexing (to 90°), with no mechanical or electrical damage ensuing. Some designs have been developed utilizing certain flexible elements such as braded wire in coaxial construction, but these typically have soldered wire connections at the feed point and spacers to separate the skirt from the nearest conductive layer, all of which are potentially weak points during repeated flexing. Since such radios must often function in high-noise or other less-than-optimum conditions, a gain antenna is a desired goal which is difficult to combine with ruggedness. The rugged quality should also include a connector with an extremely long-life characteristic. The usual metal-to-metal connector is prone to failure over a long period of use, and even sooner when the radio is swung by the end of the antenna or when the antenna is repeatedly coupled and decoupled.

SUMMARY OF THE INVENTION

It is, therefore, an object of the present invention to provide an antenna structure as for a hand-held two-way radio which combines gain capability with long, dependable life span.

These qualities and others are provided in a dipole antenna which can withstand an abnormal number of flexings in all directions and a great number of coupling-decoupling cycles without failure or depreciated operating dependability.

The body of the antenna is a section of shielded coaxial cable with the shielding stripped from approximately $\lambda/4$. A flexible insulating sleeve, as of molded Teflon (TM), is placed over the still-shielded portion, and a second, preformed braided shield is slipped on to form the "skirt" of the dipole. A very strong coil spring is threaded onto the Teflon sleeve at one end and onto the metal connector housing at the other end. The connector housing is the only non-flexible portion of the entire antenna. Inside the housing, the lower end of the center conductor is in permanent electrical contact with a conductive elastomer element which is contained within a shell of an insulating elastomer. The pin of the male connector in the radio thus contacts only the flexible conductive material. With no metal-to-metal contact, there is nothing to wear and cause an intermittent or open contact between radio and antenna.

DETAILED DESCRIPTION OF THE PREFERRED EMBODIMENT

Figure 1:
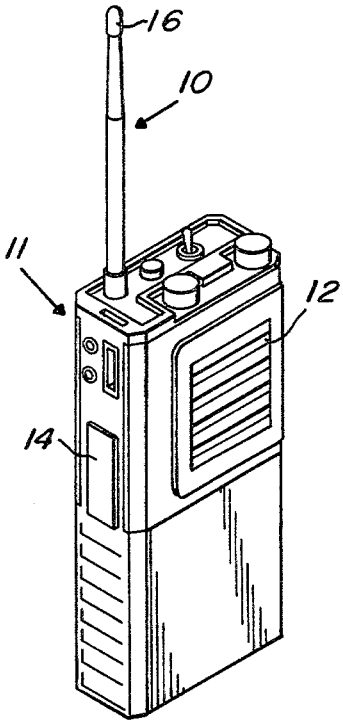
FIG. 1 is a perspective view of a typical hand-held two-way radio such as could utilize the present invention.

In FIG. 1, the antenna 10 of the present invention is shown as it would be preferably be utilized; i.e., on a hand-held two-way radio 11 such as may be used in public safety work. Such a radio is typically carried in a holster (not shown) attached to an officer's belt. The radio includes a speaker/microphone grill 12 through which sound travels in both directions. A push-to-talk switch 14 changes the device from the "receive" mode of operation to the "transmit" mode. Other controls and indicators vary from one design to another as needed.

Figure 2:
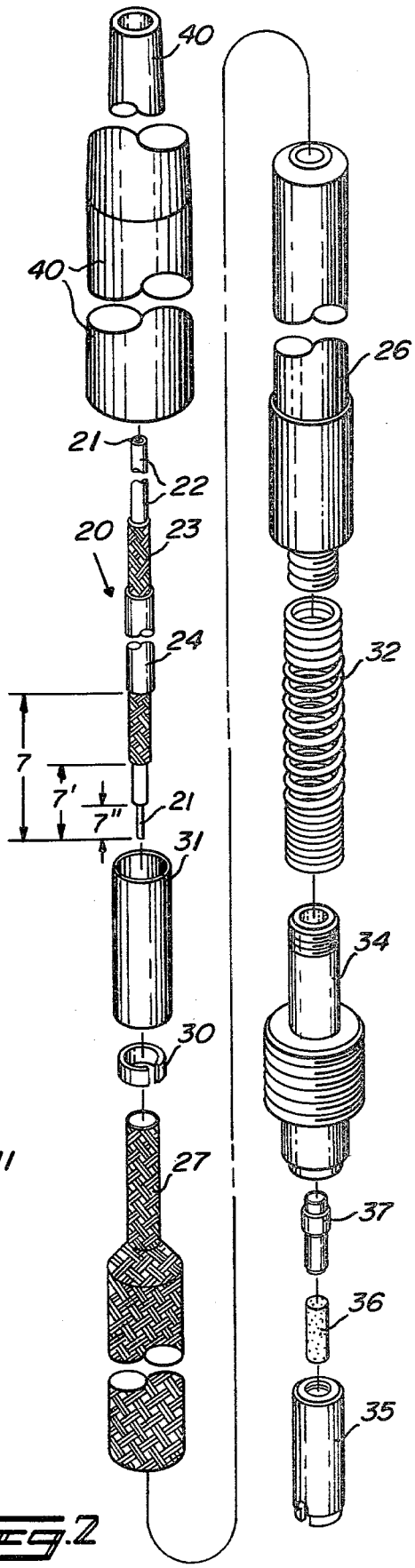
FIG. 2 is an exploded view of an antenna constructed in accordance with the invention.

In FIG. 2, an exploded view of the antenna 10 as shown, complete except for a molded resilient cap 16 which may be seen in FIG. 1.

The core of the antenna 10 is formed from a section of shielded cable 20, the total length of which is approximately one-half wave length or 8 inches in the 800–900 MHz operating range. A preferred type of cable would be RG188 coaxial cable, manufactured by Teledyne, having a center conductor 21 formed of silver-coated stranded steel wires, and an insulating layer of Teflon 22, which has been removed from a very short portion (L″) of the lower end of the cable. A braided shield 23, formed of silver-coated copper wire, has been stripped from the upper portion (approximately $\lambda/4$) and, at the lower end, a slightly longer length (L′) of braid is removed than the length of insulator 22 which was removed. An outer insulating jacket 24 is removed from a large portion of the length, including a length (L) at the lower end ($L>L'>L''$) leaving only a small portion remaining on the lower half of the cable, as shown in the drawing.

A resilient molded sleeve 26, preferably made of Teflon is then placed snugly over the upper part of the still-jacketed portion of the cable 20. A pre-formed section 27 of braided shielding, having an upper portion formed with a diameter approximately equal to the outside diameter of the shield 23 and a lower portion having a diameter approximately equal to the outside diameter of the Teflon sleeve 26, is slipped down over the cable 20 and the sleeve 26 to form the "skirt" of the dipole. This connection provides the desired impedance matching or "balun" function. A secure electrical connection is made from the upper end of the shield 27 to the upper end of the shield 23 by a metal ring 30 which is tightly crimped over the shields 23, 27. A section of heat shrink tubing 31 is applied and shrunk over the joined shielded portions to maintain the shape of the preformed shield and maintain it in tight contact with the inner shield. A pre-formed coil spring 32 is preferably formed of music wire and has a pitch at either end for forming a "thread", the upper end threading over molded threads of the Teflon sleeve 26, and the lower end over a threaded portion of a metal connector housing 34. The center portion of the coil spring 32 has a substantially greater pitch and provides the necessary flexibility and strength at the connector end of the antenna 10. Within the connector housing 34 is a molded insulator 35, preferably of Teflon. Inside the insulator 35 is a contact 36 made of a highly conductive elastomer, the contact 36 being retained within the insulator 35 and insulated thereby from the connector housing 34. A pin 37 is permanently attached, as by soldering, to the end of the cable 20 from which the insulator 22 has been stripped. When the antenna is assembled, the pin 37 will be in firm contact with the elastomer contact 36. Following the mechanical assembly of the antenna, the entire unit may be coated, as by dipping or molding with polyurethane to form a jacket 40. The jacket 40 may extend over the upper end of the antenna 10 or may stop at the upper end of the center conductor 21 and a molded insulator cap 16 may be cemented over the upper end of the jacket 40.

Figure 3:
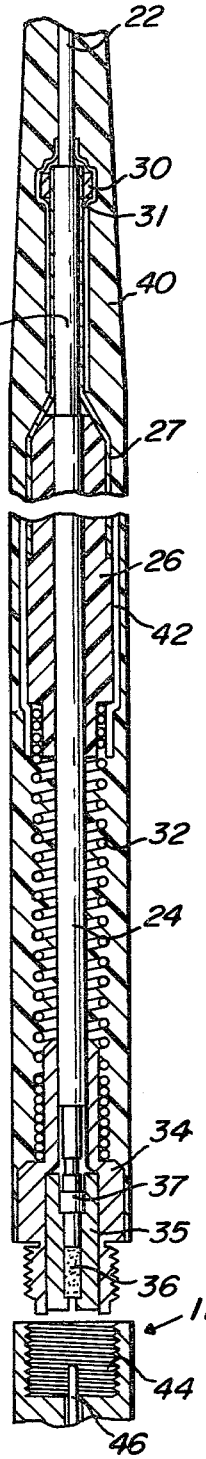
FIG. 3 is a partially cut-away view of the antenna of FIG. 2 and a cut-away portion of the mating connector of the radio shown in FIG. 1

FIG. 3 is a partially cut-away view of the antenna 10 showing the coaxial cable within the various members as described with respect to FIG. 2. In FIG. 3 an additional portion of shrink tubing 42 of a larger diameter than that of the portion 31 is applied over the end of the shielding 27 and extends over the lower portion of the teflon sleeve 26 and the upper end of the spring 32. Below the end of the antenna 10 is shown a small portion of the radio 11 with a threaded portion 44 for mating with the lower end of the connector housing 34. A pin 46 which is insulated from the threaded portion 44 penetrates the connector housing 34, contacting the conductive elastomer 36 as the antenna is coupled into the radio 11. Since it has been determined that much of the connector wear of such antennas is due to repeated coupling and decoupling while the radio is being held in the users hands, the above described non-wearing connection provides essentially an unlimited lifetime in contrast to the relatively short life of a metal-to-metal contactor.

Figure 4:
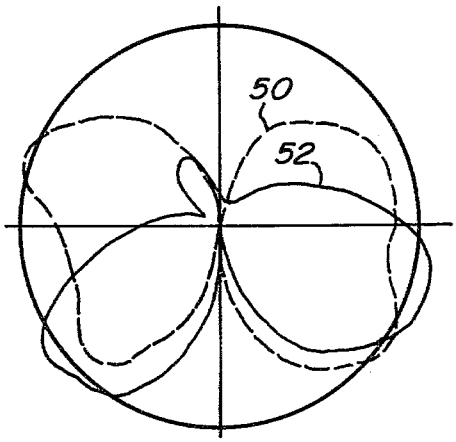
FIG. 4 is a diagram showing the radiation pattern of the antenna in a vertical plane as compared with a quarter wave length antenna.

FIG. 4 is an antenna pattern chart in the vertical plane showing in curve 50 the relatively symmetrical and substantially above horizon pattern of the antenna of the present invention. Antenna pattern 52 is of the quarter wave whip antenna typically used in such applications. In the horizontal plane, the pattern of the quarter wave antenna would show a substantial null due to the head of the user, whereas the antenna pattern of the dipole antenna is substantially unaffected by the user's body.

Thus there has been shown and described an antenna in accordance with the present invention which provides high gain with exceptional resiliency and long life as shown by the severest testing conditions. Other modifications and variations are possible and it is intended to cover all such as fall within the spirit and scope of the appended claims.

What is claimed is:

1. A method of constructing a dipole antenna for portable radio use and comprising the steps of:

(a) cutting to approximately on-half wavelength a coaxial cable consisting of a center conductor of stranded wire, a layer of insulation over the stranded wire, a braided shield over the insulation layer; and an outer insulating jacket over the braided shield;

(b) stripping said jacket from all but a small portion of the cable length;

(c) stripping the shield from approximately the upper half of said cable and a very short length of the lower end thereof;

(d) removing the inner insulating layer from a very short portion of the lower end of said cable;

(e) permanently affixing a connector pin to the lower end of said cable;

(f) slipping a flexible, molded insulating sleeve onto the cable and over the still-shielded portion thereof;

(g) providing a portion of braided shielding formed with a portion having an inside diameter substantially equal to the outside diameter of the shielded portion of the cable and a second portion having an inside diameter substantially equal to the outside diameter of the insulating sleeve;

(h) placing said formed shield over the insulating sleeve and the exposed portion of the cable shield;

(i) applying a metal ring over the double layer of shielding and crimping said ring thereon;

(j) applying a section of heat shrink tubing over the crimped ring and the smaller portion of the formed shield and heat shrinking the tubing thereon;

(k) providing a metal connector housing having a threaded portion for mating with a portion of the two-way radio;

(l) inserting a molded section of flexible insulating elastomer into the connector housing;

(m) inserting a portion of a flexible conductive elastomer into the center of the insulating elastomer;

(n) providing a coil spring formed of music wire and having a pitch at the upper end for mating with threads on the lower end of the insulating sleeve and at the other end having a pitch for mating with threads on the upper end of the connector; and (o) providing a resilient insulating cover over the entire antenna.

2. A flexible antenna as for a hand-held radio and comprising in combination:

a half-wave length section of flexible coaxial cable having an inner conductor, having an insulating jacket stripped from slightly more than the upper half of the cable and from a short length (L) at the lower end, having a first braided shield stripped from the upper half and from a length (L') at the lower end which is shorter than L, and having an inner insulating layer stripped from the lower end for a length (L'') which is shorter than L';

a metal contact pin fixedly attached to the bare end of the inner conductor;

a molded flexible insulating sleeve positioned over the still-jacketed portion of the cable;

a second braided shield positioned over the insulating sleeve and over and in electrical contact with the upper exposed end of the first braided cable shield;

mechanical means for clamping the second braided shield against the first braided shield;

a metal connector housing having contained therein an insulating shell with a resilient conductive material positioned in the center of said shell;

a coil spring for coupling to the insulating sleeve at one end and to the metal housing at another end, the metal contact pin being thereby forced into contact with the conductive material within the connector housing.

3. A flexible antenna in accordance with claim 2 wherein the mechanical means for clamping comprises a metal ring crimped over a portion of the contacting areas of the first and second braided shields.

4. A flexible antenna in accordance with claim 2 and further including shape retaining means applied over the contacting areas of the first and second braided shields.

* * * * *

UNITED STATES PATENT AND TRADEMARK OFFICE

CERTIFICATE OF CORRECTION

PATENT NO. : 4,205,319

DATED : May 27, 1980

INVENTOR(S) : Bernard Gasparaitis and Charles D. Albright

It is certified that error appears in the above—identified patent and that said Letters Patent is hereby corrected as shown below:

Column 1, line 26, delete "braded" and insert --braided--.

Column 3, line 58, delete "on-half" and insert --one-half--.

Signed and Sealed this

*Sixth* Day of *January 1981*

[SEAL]

*Attest:*

SIDNEY A. DIAMOND

*Attesting Officer*

*Commissioner of Patents and Trademarks*